United States Patent [19]

Niikawa

[11] Patent Number: 4,927,277

[45] Date of Patent: May 22, 1990

[54] PRINTER HAVING A DEVICE FOR ADJUSTING THE PRINTING CONDITION, DEPENDING UPON PAPER THICKNESS

[75] Inventor: Takeshi Niikawa, Nagoya, Japan

[73] Assignee: Brother Kogyo Kabushiki Kaisha, Japan

[21] Appl. No.: 332,057

[22] Filed: Apr. 3, 1989

[30] Foreign Application Priority Data

Apr. 6, 1988 [JP] Japan ..... 63-84423

[51] Int. Cl.[5] ..... B41J 11/50

[52] U.S. Cl. ..... 400/56; 355/313; 400/605; 400/703

[58] Field of Search ..... 400/56, 57, 58, 625, 400/605, 703, 624; 355/311, 313

[56] References Cited

U.S. PATENT DOCUMENTS

| | | | |
|---|---|---|---|
| 4,473,314 | 9/1984 | Imaizumi | 400/625 |
| 4,676,675 | 6/1987 | Suzuki et al. | 400/56 |
| 4,737,645 | 4/1988 | Lahr | 400/56 |
| 4,797,017 | 1/1989 | Okouchi | 400/56 |

FOREIGN PATENT DOCUMENTS

| | | | |
|---|---|---|---|
| 227116 | 7/1987 | European Pat. Off. | 400/605 |
| 2778 | 1/1982 | Japan | 400/57 |
| 39978 | 3/1982 | Japan | 400/57 |
| 146672 | 9/1982 | Japan | 400/703 |
| 123688 | 7/1984 | Japan | 400/57 |
| 30367 | 2/1985 | Japan | 400/57 |
| 62-187063 | 8/1987 | Japan | 400/56 |
| 62-193866 | 8/1987 | Japan | 400/56 |

*Primary Examiner*—Eugene H. Eickholt
*Attorney, Agent, or Firm*—Oliff & Berridge

[57] ABSTRACT

A printing apparatus for printing on a recording medium, including a print head for printing on the recording medium supported by a platen, while the print head is moved along the platen, a changeover device for changing a printing condition of the print head, a signal generating device for generating a trigger signal indicative of a possibility of a change in the medium thickness, a medium thickness detecting device for detecting the medium thickness, and a control device responsive to the trigger signal from the signal generating device, for activating the medium thickness detecting device to detect the medium thickness, and activating the changeover device to change the printing condition of the print head, depending upon the detected medium thickness.

18 Claims, 8 Drawing Sheets

PRINTER HAVING A DEVICE FOR ADJUSTING THE PRINTING CONDITION, DEPENDING UPON PAPER THICKNESS

BACKGROUND OF THE INVENTION

1. Field of the Invention

The present invention relates generally to a printing apparatus, and more particularly to an arrangement for adjusting or changing the printing condition of a print head of the printer.

2. Discussion of the Prior Art

A printing apparatus commonly has a platen for supporting a recording medium, and a print head for effecting a printing operation on the recording medium. The printing operation takes place while the print head is moved along the length of the platen. The apparatus generally accepts different types of recording medium which have different thicknesses, and even accepts two or more sheets of paper or other recording media which are superposed on each other. Thus, the thickness of the recording medium or total thickness of the media is not constant. For assuring excellent printing quality, it is required to adjust the printing condition of the print head, depending upon the specific thickness of the recording medium or media. The term "printing condition" used herein is interpreted to mean a condition that influences the printing quality, such as a so-called head gap which is a distance between the print head and the surface of the platen, or a printing pressure which is applied to the recording medium from a suitable printing element or elements such as dot matrix print wires. An appropriate device or devices are required to change or adjust a selected parameter or parameters (e.g., head gap or position of the print head with respect to the platen, or printing pressure) of the printing condition.

An example of such a device for adjusting the printing condition on a printer is disclosed in laid-open Publication No. 62-193866 of unexamined Japanese Patent Application, wherein the thickness of a recording paper is detected by a paper thickness sensor, to adjust the head gap depending upon the detected paper thickness. The printer disclosed in this publication is operated in two modes associated with the adjustment of the head gap. The modes are selected by a selector switch when printing is effected on cut sheets. In the first mode, the thickness of each cut sheet is detected when the printer is loaded with the cut sheet. The second mode is selected when printing is effected continuously on successively supplied cut sheets having the same thickness. In this second mode, only the thickness of the first or initially supplied cut sheet is detected by the sensor, and the head gap is adjusted based on the detected thickness of the first sheet. The adjusted head gap is kept unchanged for the following sheets, whereby the printing operation can be performed in a relatively efficient way.

In the printer disclosed in the above-identified publication, it is necessary to provide suitable means for determining the first or initially supplied cut sheet, in order to command the paper thickness sensor to detect the thickness of the supplied sheet. However, the publication does not described such mean.

SUMMARY OF THE INVENTION

It is therefore an object of the present invention to provide a printing apparatus which is capable of automatically adjusting a printing condition such as a head gap, without any special operation by an operator, when situations require an adjustment or change of the printing condition.

The above object may be accomplished according to the concept of the present invention, which provides a printing apparatus for printing on a recording medium, comprising: a platen mounted on a frame, for supporting the recording medium; a print head for effecting a printing operation on the recording medium supported by the platen, while the print head is moved along the platen; changeover means for changing a printing condition of the print head; signal generating means for generating a trigger signal indicative of a possibility of a change in a thickness of the recording medium; medium thickness detecting means for detecting the thickness of the recording medium; and control means responsive to the trigger signal from the signal generating means, for activating the medium thickness detecting means to detect the thickness of the recording medium, and activating the changeover means to change the printing condition of the print head, depending upon the thickness of the recording medium detected by the medium thickness detecting means.

For example, there is a possibility of a change in the thickness of the recording medium, when a plurality of selectively used paper containers or casings are changed from one to another. Usually, the different paper containers accommodate different types of paper, namely, papers which have different sizes and forms. It is highly probable that the different types of paper have different thicknesses. If the present invention is applied to a printer having such paper containers, for instance, the signal generating means generates the trigger signal when the currently selected paper container is changed from one to another, and the medium thickness detecting means and the changeover means are automatically activated in response to the trigger signal, to adjust the printing condition, without the operator's attention to the thickness of the currently supplied recording medium.

It is also noted that when a printing operation is effected in a continuous fashion on successively supplied sheets of the same type, it is unlikely that the thickness of the recording medium varies from one sheet to another. That is, it is unlikely that the successively supplied sheets have different thicknesses. In this situation, therefore, the changeover means is not activated for each of the successively supplied sheets.

As described above, the instant printing apparatus is adapted to automatically change the printing condition when the thickness of the recording medium is changed. However, the medium thickness detecting means and the changeover means are not uselessly activated. Thus, the printing apparatus of the present invention permits an efficient printing operation with excellent print quality, with a minimum degree of manipulation by the operator.

The printing condition to be controlled by the changeover means may be a head gap which is a distance between the print head and the surface of the platen. Where the print head is a dot matrix print head having at least one print wire, the printing condition may be a printing pressure of the print wires which acts on the recording medium.

The printing apparatus may comprise a plurality of medium delivery devices for deliverying different types of the recording medium. In this case, medium selector means is provided for selecting one of the medium delivery devices from which the recording medium is delivered for printing by the print head. Thus, the medium selector means operates as the signal generating means. The medium selector means may be an operator-controlled selector switch for selecting one of the medium delivery devices. In this instance, the control means may include a counter whose content is changed each time the selector switch is operated, so that the medium thickness detecting means and the changeover means are activated depending upon the content of the counter.

The printing apparatus may include a medium supply device for accommodating and delivering the recording medium, and medium-absence detector means for generating a signal indicative of an absence of the recording medium in the medium supply device. In this case, the medium-absence detector means operates as the signal generating means, and the signal generated by the medium-absence detector means serves as the trigger signal.

Where the pringing apparatus uses a medium supply device including a feed roll, and a sheet stacker each supporting a stack of cut sheets and pressing a top sheet of the stack against the feed roll, the signal generating means is adapted to generate the trigger signal when the sheet stacker is moved to a fully retracted position remote from the at least one feed roll.

Where the printing apparatus uses a paper casing supported by the frame for accommodating the recording medium, the signal generating means is adapted to generate the trigger signal when the paper casing is removed from the frame.

The printing apparatus may have an operator-controlled print start switch for initiating the printing operation. In this case, the print start switch also operates as the signal generating means.

BRIEF DESCRIPTION OF THE DRAWINGS

The above and optional objects, features and advantages of the present invention will become more apparent by reading the following detailed description of presently preferred embodiments of the invention, when considered in connection with the accompanying drawings, in which.

DETAILED DESCRIPTION OF THE PREFERRED EMBODIMENTS

Figure 1:
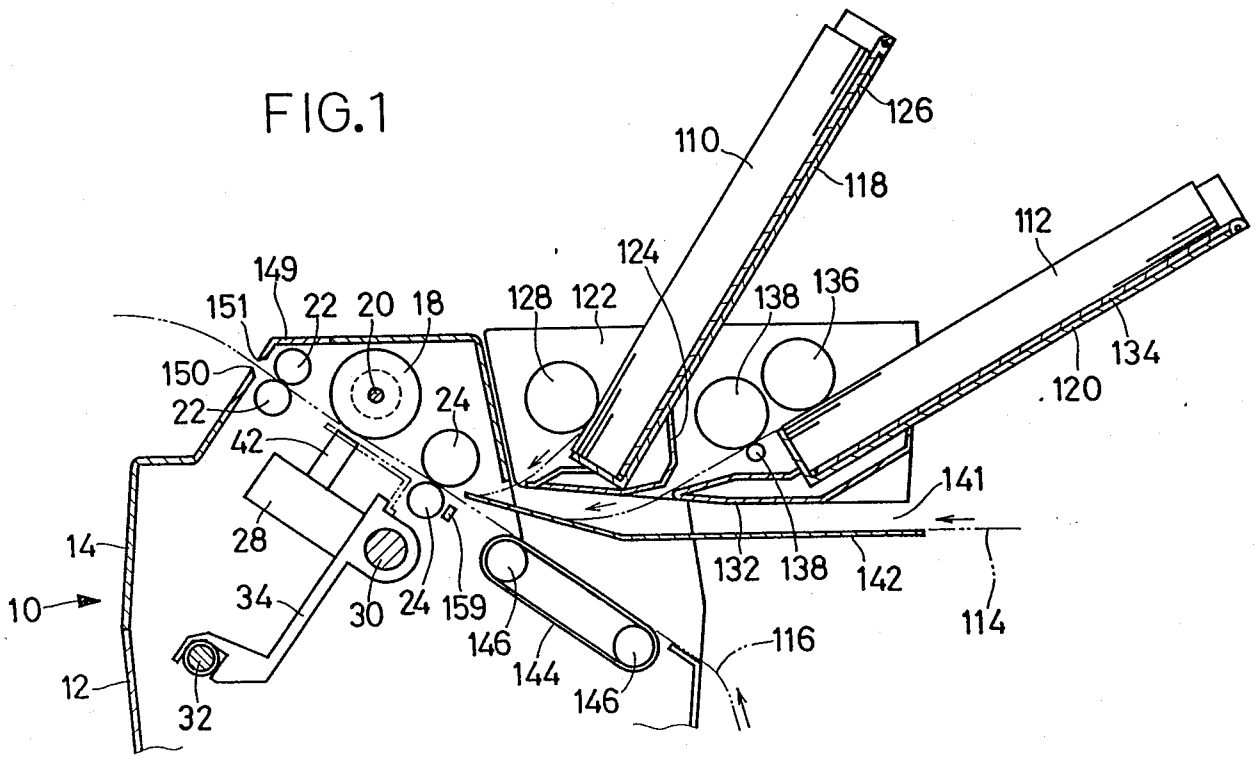
FIG. 1 is a side elevational view in cross section of one embodiment of a printing apparatus of the present invention.
Figure 4:
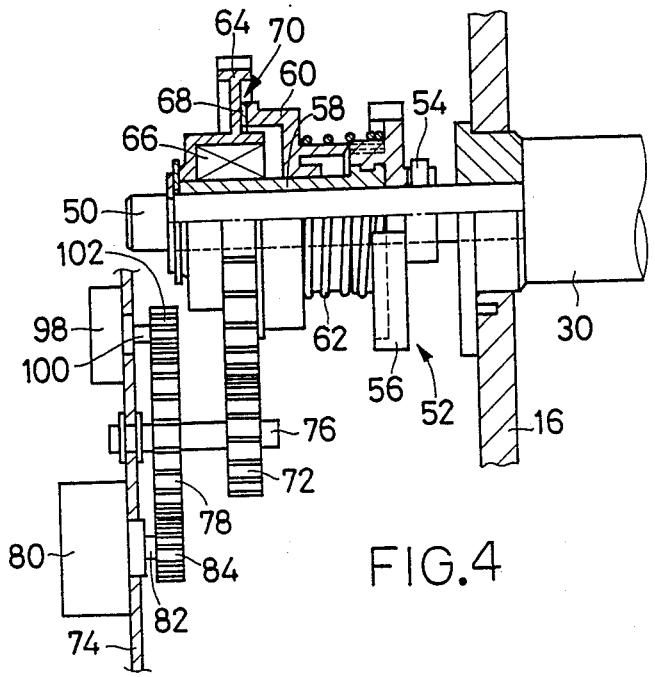
FIG. 4 is a fragmentary plan view partly in cross section showing a mechanism for moving the carriage in a direction perpendicular to the direction of its feeding movement.
Figure 7:
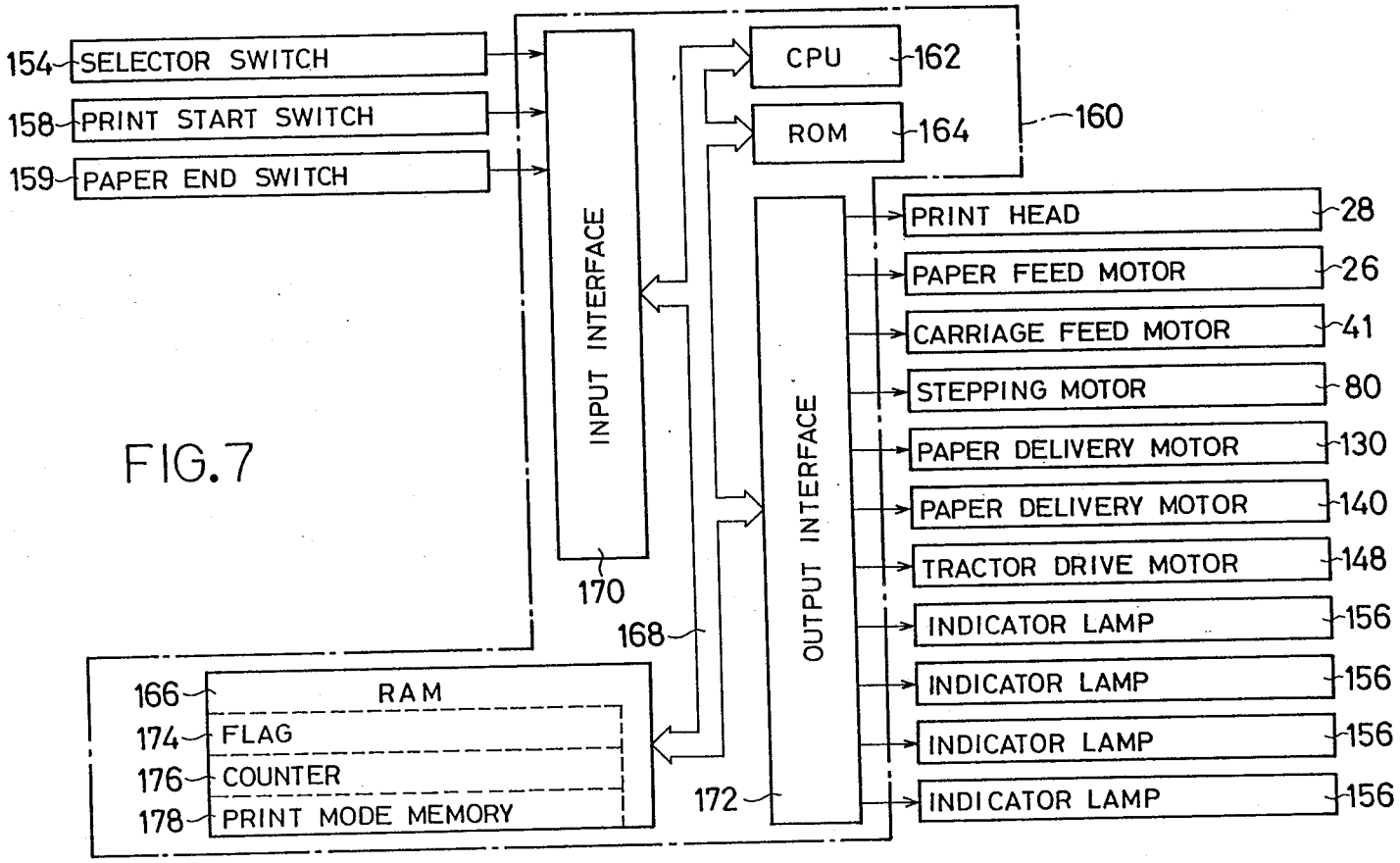
FIG. 7 is a schematic block diagram illustrating a control device for controlling the apparatus.

Referring first to FIG. 1, reference numeral 10 denotes a frame of the printing apparatus. The frame 10 includes a box-like lower covering 12, and an upper covering 14. The lower covering 12 has a pair of side plates 16 (one of which is shown in FIG. 4), by which a cylindrical platen 18 is supported at shafts 20 rotatably about its axis. On both sides of the platen 18, there are disposed a first pair of feed rolls 22 and a second pair of feed rolls 24, such that the feed rolls 22, 24 are rotatable about respective axes parallel to the axis of rotation of the platen 18. These feed rolls 22, 24 are rotated by a common paper feed motor 26 (FIG. 7).

Figure 3:
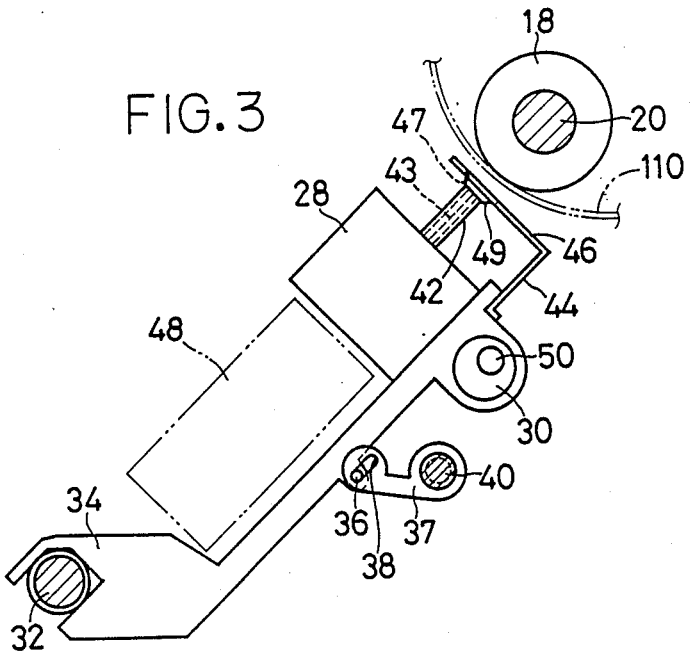
FIG. 3 is a side elevational view of the carriage.

A print head 28 is positioned opposite to the circumferential surface of the platen 18. To the side plates 16, there are attached a guide shaft 30 and a guide rail 32 such that the shaft and rail 30, 32 extend parallel to the platen 18. The print head 28 is mounted on a carriage 34 which slidably engages the guide shaft 30 and is slidably supported by the guide rail 32. The carriage 34 has a pin 36 fixed to its underside, as shown in FIG. 3. The pin 36 engages an elongate hole 38 formed in an engagement arm 37, such that the arm 37 is immovable relative to the pin 36 in the longitudinal or axial direction of the pin 36, and such that the arm 37 is movable relative to the pin 36 in the longitudinal direction of the carriage 34 (in the direction perpendicular to the length of the guide shaft 30). The engagement arm 37 has an internally threaded portion which engages a feedscrew 40 which extends parallel to the platen 18. With the feedscrew 40 rotated by a carriage feed motor 41 (FIG. 7), the carriage 34 is reciprocated leftward and rightward parallel to the platen 18.

The print head 28 is a dot-matrix type having a plurality of print wires 43 which extend through a nose 42 whose free end is spaced by a small distance away from the surface of a recording medium supported on the platen 18. In a printing operation, the print wires 43 are selectively activated or moved from the retracted position to the advanced or printing position, by energization of respective solenoid coils, while the print head 28 on the carriage 34 is moved along the guide shaft 30. A guide plate 44 is secured to the carriage 34 such that the guide plate 44 faces the platen 18, so as to guide the recording medium (e.g., cut sheet 110 as indicated in FIG. 3) which is fed between the platen 18 and the guide plate 44. This guide plate 44 is generally L-shaped, having a guide portion 46 which extends perpendicularly to the surface of the carriage 34 on which the print head 28 is mounted. The guide portion 46 has an opening 47 aligned with the nose 42 of the print head 28. Between the guide portion 46 and the free end face of the nose 42, there is passed an active portion of a print ribbon 49 which is supplied from a ribbon cassette 48 also mounted on the carriage 34, as shown in FIG. 3.

Figure 2:
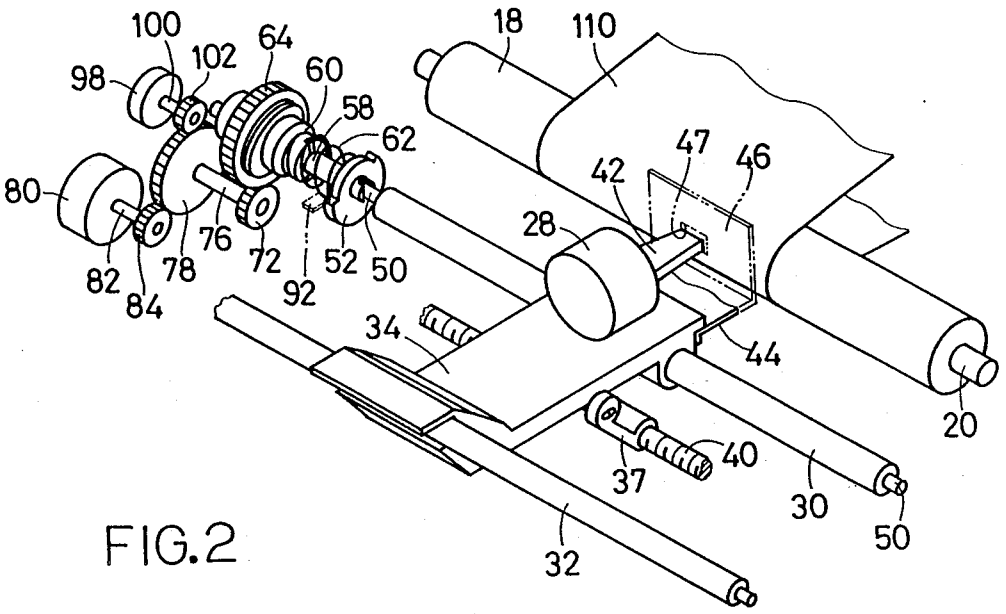
FIG. 2 is a fragmentary perspective view of the printing apparatus, showing a carriage feed mechanism.

Referring to FIG. 2, eccentric shafts 50 are attached to the opposite ends of the guide shaft 30, such that the eccentric shafts 50 are eccentric with respect to the axis of the guide shaft 30. One of the eccentric shafts 50 is provided with a stop member 52 fixed thereto by a pin 54 (FIG. 4) so that the stop member 52 is rotatable with the eccentric shaft 50. The stop member 52 has a flange portion 56 having a relatively large diameter, and a sleeve 58 formed integrally with the flange portion 56. A collar 60 is slidably fitted on the outer circumferential surface of the sleeve 58, such that the collar 60 is rotatable with the flange portion 56 but is immovable relative to the flange portion 56 in the axial direction. The collar 60 is biased by a spring 62, in a direction away from the flange portion 56. The sleeve 58 engages a drive gear 64 via a one-way clutch 66. The collar 60 has a friction plate 68 secured to its end face opposite to the drive gear 64, so that the friction plate 68 is held in pressed contact with the drive gear 64 under a biasing action of the spring 62, whereby a friction clutch 70 is provided. This friction clutch 70 is adapted to transmit a rotary motion of the drive gear 64 to the collar 60 when a load torque between the drive gear 64 and the collar 60 is smaller than a preset value, while the clutch 70 slips between the drive gear 64 and the friction plate 68 when the load torque exceeds the preset value, thereby inhibiting transmission of the rotary motion to the collar 60.

The drive gear 64 meshes with a small gear 72 having a relatively small diameter, which is mounted on a shaft 76 rotatably supported by a holder 74 which constitutes a part of the frame 10. The shaft 76 has fixed thereto a large gear 78 having a relatively large diameter, which meshes with an output gear 84 fixed to an output shaft 82 of a stepping motor 80. In this arrangement, the drive gear 64 is rotated in opposite directions by a bidirectional operation of the stepping motor 80.

When the drive gear 64 is rotated in the forward direction (clockwise direction as seen in FIG. 2), the transmission of the rotary motion of the gear 64 to the sleeve 58 is inhibited by the one-way clutch 66 indicated above, and the rotary motion of the drive gear 64 is transmitted to the eccentric shaft 50 via the friction clutch 70 and the collar 60. When the drive gear 64 is rotated in the reverse direction (counterclockwise direction as seen in FIG. 2), on the other hand, the one-way clutch 66 transmits the rotary motion of the drive gear 64 directly to the sleeve 58, whereby the eccentric shaft 50 is rotated. When the guide shaft 30 is rotated by the rotation of the eccentric shaft 50, the carriage 34 and the print head 28 mounted thereon are advanced toward the platen 18 and retracted away from the platen 18, since the eccentric shafts 50 are eccentric with respect to the guide shaft 30. The print head 28 is advanced when the eccentric shafts 50 are rotated in the forward direction, and retracted when the shafts 50 are rotated in the reverse direction. An amount of the movement of the print head 28 toward and away from the platen 18 can be controlled as needed by controlling the amount of operation or operation time of the stepping motor 80. Consequently, the amount of the head gap between the print head 28 and the surface of the platen 18 can be suitable adjusted, for assuring optimum quality of printing on the recording medium. In the present embodiment, the eccentric shafts 50, stop member 52, collar 60, gears 64, 72, 78, 84, one-way clutch 66, friction clutch 70 and stepping motor 80 constitute a major portion of changeover means for changing the printing condition of the print head, i.e., the amount of the head gap (position of the print head 28 with respect to the platen 18).

Figure 5:
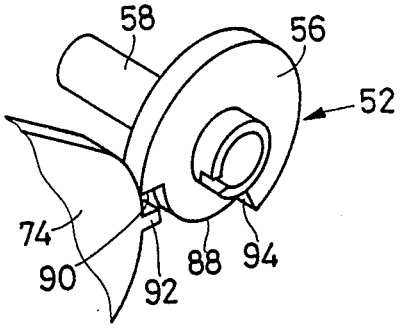
FIG. 5 is a fragmentary perspective view showing a stop member used in the mechanism of FIG. 4.

As shown in FIG. 5, the stop member 52 has a circumferential cutout 88 formed in a part of the radially outer circumferential portion. The circumferentially opposite ends of the cutout 88 are defined by a first and a second radial surface 90, 94. A stop 92 is secured to the holder 74, such that the stop 92 is located within the circumferential cutout 88. When the eccentric shafts 50 are rotated in the reverse direction, the first radial surface 90 is brought into abutting contact with the stop 92, whereby the fully retracted position of the carriage 34 is determined. On the other hand, the cutout 88 is dimensioned or the position of the second radial surface 94 is determined, so that the second radial surface 94 is spaced a certain distance away from the stop 92 when the carriage 34 is moved to its fully advanced position with the print head 28 abutting on the platen 18, by the forward rotation of the eccentric shafts 50. The large gear 78 meshes with a gear 102 fixed to a shaft 100 of a friction device 98, so that a resistance is applied to the gear 78 during its rotation.

As shown in FIG. 1, the present printing apparatus is adapted to accept any one of four different types or kinds of recording media 110, 112, 114, 116. The first and second recording media 110, 112 are cut sheets accommodated in stacks in respective first and second stacker casings 118, 120. The cut sheets are automatically supplied one at a time, to a predetermined printing start position. Behind the upper covering 14, there is provided a support structure 122 to which the first stacker casing 118 is removably attached via a bracket 124, such that the casing 118 is inclined with its lower end located nearer to the upper covering 14 than its upper end. This first stacker casing 118 is open upwardly and frontwardly of the printing apparatus, and houses a first sheet stacker 126 such that the stacker 126 is pivotally supported at its upper end. The first paper stacker 126 is biased by a spring 126 in a direction away from the bottom surface of the casing 118, so that the stack of cut sheets 110 on the stacker 126 is held in pressed contact with a delivery or feed roll 128. With the delivery roll 128 rotated by a paper delivery motor 130 (FIG. 7), the uppermost cut sheet 110 of the stack is delivered by the delivery roll 128 from the stacker 126, toward the feed rolls 24 described above. When printing is effected on the cut sheets 110 (first recording medium), the apparatus is placed in a first automatic cut sheet feed mode (ACSF1 mode).

Behind the first stacker casing 118, the second stacker casing 120 is removably attached to the support structure 122 via a bracket 132, such that the angle of inclination of the casing 120 with respect to the horizontal plane is smaller than that of the first stacker casing 118. The casing 120 has the same construction as the casing 118, and is provided with a second sheet stacker 134 and a delivery or feed roll 136. Further, feed rolls 138 are provided adjacent to the delivery roll 136, for feeding the cut sheets 112 (second recording medium) delivered from the second sheet stacker 134, toward the feed rolls 24. The rolls 136, 138 are rotated by a common paper delivery motor 140. When printing is effected on the cut sheets 112, the printing apparatus is placed in a second automatic cut sheet feed mode (ACSF2 mode).

The third recording medium 114 also takes the form of a cut sheet, but is manually inserted into the apparatus by the operator. Namely, a paper inlet 141 is provided at the rear end of the upper covering 14, and a manual sheet insertion tray 142 is disposed so as to extend substantially parallel to the bottom wall of the lower covering 12. The cut sheet 114 (third recording medium) is guided by the tray 142 toward the feed rolls 24. When this third recording medium 114 is used, the apparatus is placed in a SHEET mode.

The fourth recording medium 116 takes the form of a web, which is fed by a pin tractor 144 disposed within the lower covering 12. The pin tractor 144 has pins which are engageable with two parallel rows of perforations formed along the longitudinal edges of the web. The pin tractor 144 is rotated by a pair of feed rolls 146, which are rotated by a tractor drive motor 148 (FIG. 7), whereby the web 116 is fed toward the feed rolls 24. When printing is effected on the web 116, the apparatus is placed in a FORMS mode. The upper covering 14 has a lid 149 pivotally attached to its front portion, as shown in FIG. 1. This lid 149 has an outlet 150 through which the printed recording medium is discharged out of the apparatus. The lid 149 has a portion which defines the upper edge of the outlet 150, and is formed with a sharp cutting edge that serves as a cutter 151 for cutting the printed recording medium.

Figure 6:
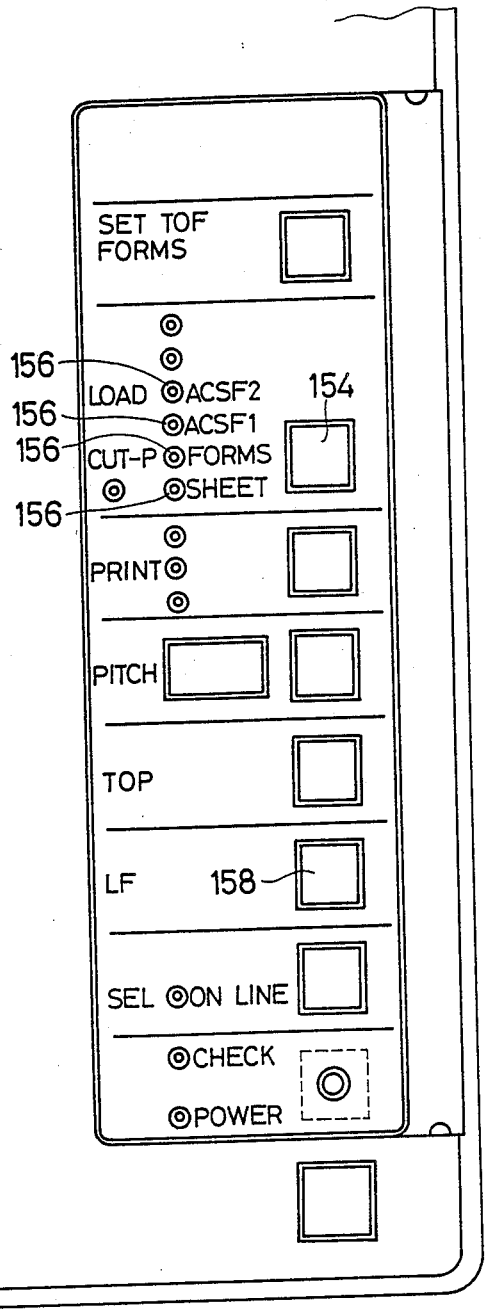
FIG. 6 is a fragmentary plan view of an operator's control panel for controlling the apparatus.

The selection of the recording medium to be used, or the selection of the operating mode of the printing apparatus is achieved by a mode selector switch 154 provided on an operator's control panel 152 as shown in FIG. 6. Adjacent to the selector switch 154, there are provided indicia indicative of the four operation modes ACSF1, ACSF2, SHEET and FORMS referred to above, and corresponding four indicator lamps 156. Each time the selector switch 154 is pressed, the currently selected mode is changed from one to the next. The currently selected mode is indicated by the energization of the appropriate indicator lamp 156. The operator's control panel 152 further has a PRINT START switch 158 for initiating a printing operation.

The printing apparatus constructed as described above is operated under the control of a control device 160 as shown in FIG. 7. This control device 160 is principally constituted by a computer which includes a central processing unit (CPU) 162, a read-only memory (ROM) 164, a random-access memory (RAM) 166, and a bus 168. The bus 168 is connected to an input interface 170, to which are connected the mode selector switch 154, the PRINT START switch 158, and a PAPER END switch 159 located near the feed rolls 24 as shown in FIG. 1. The PAPER END switch 159 is disposed on the frame 10 of the apparatus, so as to detect the presence or absence of the recording medium. The bus 168 is connected through an output interface to the print head 28, the paper feed motor 26, the carriage feed motor 41, the stepping motor 80, the paper delivery motors 130, 140, the tractor drive motor 148 and the four indicator lamps 156.

The RAM 166 incorporates a flag 174, a counter 176, and a PRINT MODE memory 178 for storing data representative of the currently selected operation mode of the apparatus. The content or count of the counter 176 is changed each time the mode selector switch 154 is pressed. The appropriate one of the four indicator lamps 156 is illuminated to indicate the currently selected mode. The content of the PRINT mode memory 178 represents the current count of the counter 176, i.e., the currently selected mode of the apparatus. It is noted that the four different types of recording media 110, 112, 114, 116 are used in the respective four different operation modes. Therefore, a change of the operation mode from one to another means a change in the type of the recording medium on which printing is effected. The ROM 164 stores various control programs necessary to control a printing operation. The control programs include a head-gap changeover routine and a paper feed control routine for controlling the head gap and the paper loading operation, as illustrated in the flow chart of FIG. 8. Referring to the flow chart, there will be described the head-gap changeover routine and the paper feed control routine, which are implemented when the recording medium to be used is changed from one type to another. In the present specific example, the printing apparatus is initially placed in the ACSF1 mode in which the first recording medium 110 (cut sheets) is used.

In response to an operation of the PRINT START switch 158, the CPU 162 executes step S1 in which the data representative of the currently selected operation mode is read out from the PRINT MODE memory 178. The control flow then goes to step S2 to determine whether the operation mode has been changed after the termination of the preceding printing cycle. This determination is made by comparing the count of the counter 176 represented by the data read out in step S1, with the current content of the counter 176. When the operation mode has been changed, an affirmative decision (YES) is obtained in step S2, and the control flow goes to step S3 in which the currently established operation mode is stored in the PRINT MODE memory 178. In the present example, the operation mode ACSF1 is replaced by the operation mode ACSF2, and the data representative of this newly established mode ACSF2 is stored in the PRINT MODE memory 178.

Then, the control flow goes to step S4 to set the flag 174, and step S5 in which the print head 28 is moved to its fully retracted position farthest from the platen 18. Described more specifically, the stepping motor 80 is operated in the reverse direction to retract the carriage 34 until the first radial surface 90 of the cutout 88 of the stop member 52 is brought into abutting contact with the stop 92. This abutting contact of the surface 90 with the stop 92 determines the fully retracted position of the print head 28, in which there is provided a sufficient spacing or gap between the free end of the nose 42 of the print head 28 and the surface of the platen 18, so that the gap can accommodate the thickness of any one of the four different types of recording media 110, 112, 114, 116.

In the next step S6, the newly selected second recording medium 112 (cut sheet) is fed to the predetermined printing start position, by the delivery roll 136 and feed rolls 138 which are driven by the paper delivery motor 140. Step S6 is followed by step S7 wherein the CPU 162 determines whether the recording medium 112 has been fed to the printing start position or not. This determination is accomplished by checking if the PAPER END switch 159 has been kept in a state indicative of the absence of the recording medium, for a predetermined length of time after the activation of the paper delivery motor 140. In this example, it is assumed that the second recording medium 112 has been correctly fed to the printing start position, with the control device 160 placed in the mode ACSF2, and consequently an affirmative decision (YES) is obtained in step S7.

Since the flag 174 has been placed in the set state in step S4, an affirmative decision (YES) is obtained in step S8, and the control flow goes to step S9 to change or adjust the head gap, i.e., a distance between the print head 28 and the platen 18, or the printing position of the print head 28 with respect to the platen 18. More particularly, the stepping motor 80 is operated in the forward direction to advance the carriage 34 until the end of the nose 42 of the print head 28 comes into abutting contact with the surface of the recording medium 112. Then, the stepping motor 80 is operated in the reverse direction for a predetermined time, to move the print head 28 a suitable distance away from the recording medium 112, so that there is provided an optimum gap between the print head 28 and the recording medium 112. In other words, the head gap between the print head 28 and the platen 18 is adjusted depending upon the thickness of the newly selected second recording medium 112, so that the optimum gap is provided between the print head 28 and the recording medium 112. While the stepping motor 80 is operated by a small amount even after the print head 28 has been brought into contact with the recording medium 112, the friction clutch 70 slips so as to allow a relative movement between the drive gear 64 and the stop member 52, whereby the print head 28 contacting the medium 112 is no longer advanced toward the platen 18. The position in which the print head 28 contacts the recording medium 112 is determined by the thickness of the medium 112. That is, the position of the print head 28 relative to the platen 18 is determined by the thickness of the medium 112. Therefore, the thickness of the medium 112 can be determined by the position of the print head 28 (carriage 34). Since the thickness of the second recording medium 112 is different from that of the first recording medium 110, the head gap between the print head 28 and the platen 18 is changed from the value in the preceding mode ACSF1, by moving the print head 28 away from the recording medium 112 by the predetermined distance, which is the optimum gap between the print head 28 and the surface of the medium 112. Thus, the head gap is suitably adjusted to assure desired printing quality, inspite of a change in the thickness of the recording medium. After the head gap is adjusted in step S9, the control flow goes to step S10 in which the flag 174 is reset, and returns to the main control routine.

While step S2 is followed by step S3 and the following steps as described above where the recording medium is changed from the first recording medium 110 to the second recording medium 112, a negative decision (NO) is obtained in step S2 where the recording medium is not changed. In this case, steps S3–S5 are skipped, and step S2 is directly followed by step S6 wherein the first recording medium 110 is fed to the printing start position. With the meduim 110 detected by the PAPER END switch 159, an affirmative decision (YES) is obtained in step S7. However, a negative decision (NO) is obtained in step S8, and the control goes back to the main control routine, skipping steps S9 and S10.

In the case where the first recording medium 110 is not present on the first sheet stacker 126 in the first stacker casing 118, a negative decision (NO) is obtained in step S7, and the control flow goes to step S11 to set the flag 174, and step S12 wherein the print head 28 is moved to the fully retrated position. The control then goes back to the main control routine. When the first sheet stacker 126 is loaded with the first recording medium 112 and the PRINT START switch 158 is turned on, step S1 is executed. However, a negative decision (NO) is obtained in step S2, and the control flow goes to step S6 to feed the recording medium 110 to the printing start position. Since the first recording medium 110 is supplied from the first sheet stacker 126 and the flag 174 has been set in step S11, affirmative decisions (YES) are obtained in step S7 and S8, and step S9 is implemented to adjust the head gap. Although the first sheet stacker 126 is usually loaded with the same type of recording medium as used before, i.e., first recording medium 110, it is possible that the stacker 126 is loaded with another type of recording medium having a thickness different from that of the first recording medium 110. In view of this possibility, the head gap is adjusted in step S9 as described above, each time the stacker 126 is loaded with the recording medium.

When a printing operation is effected continuously on the successively supplied cut sheets 110, step S101 is implemented after the printing on each cut sheet (supplied in step S6) is completed, whereby the printed sheets 110 are discharged through the outlet 150, with the feed rolls 22, 24 rotated by the paper feed motor 26. Then, the control flow goes to step S102 to determine whether the relevant printing operation on the predetermined number of the cut sheets 110 has been completed, or not. When the printing operation has been completed, an affirmative decision (YES) is obtained in step S102, and the control flow goes back to the main control routine. When the printing operation will continue on the following cut sheet or sheets 110, a negative decision (NO) is obtained in step S102, and the control flow goes to step S6 in which the next cut sheet 110 is fed to the printing start position.

While the above description refers to the case where the recording medium is changed from the first type 110 to the second type 112, an operation to adjust the head gap is similarly performed where the recording medium is changed from the first type 110 to another type other than the second type 112, or from the other type to another type.

In the printing apparatus according to the present embodiment described above, the head gap adjustment is made for the first sheet of the newly selected or newly loaded recording medium when the operation mode (type of the recording medium) is changed, or when the currently selected recording medium is depleted. In all cases, the thickness of the newly selected or loaded recording medium may or may not be different from that of the previously used recording medium. That is, there is a possibility of a change in the thickness of the recording medium. According to the present embodiment, the head gap between the print head 28 and the platen 18 is automatically adjusted depending upon the thickness of the currently selected recording medium, in order to maintain an optimum amount of gap between the print head 28 and the recording medium, for assuring a high level of print quality, without lowering the printing efficiency. The present arrangement frees the operator from otherwise required attention to the thickness of the presently used recording medium.

A change in the type of the recording medium, and the depletion of the currently used recording medium are detected based on the output signals of the mode selector switch 154 and PAPER END switch 159. The printing apparatus requires these switches 154, 159 for selecting the operation mode and indicating the depletion of the recording medium, and therefore does not require any additional devices for detecing the situations that involve a possibility of a change in the thickness of the recording medium. In this respect, the instant printing apparatus is available without a significant increase in the cost of manufacture.

It will be understood from the foregoing description that the eccentric shafts 50, stop member 52, collar 60, gears 64, 72, 78, 84, one-way clutch 66, friction clutch 70, stepping motor 80, etc. not only constitute the changeover means for adjusting the head gap (i.e., the printing condition of the print head 28), but also constitute means for detecting the thickness of the recording medium such that the print head 28 is advanced from its fully retracted position until the print head comes into contact with the recording medium. It will also be understood that the mode selector switch 154 and the PAPER END switch 159 constitute means for generating a trigger signal, in response to which the changeover means and the medium thickness detecting means are activated to adjust the head gap, and that a portion of the ROM 164 storing the program for executing steps S1–S12 of the flow chart of FIG. 8 and a portion of the CPU 162 for executing these steps constitute control means for controlling the changeover means and the medium thickness detecting means.

Figure 9:
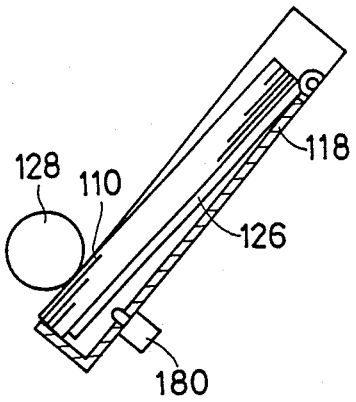
FIG. 9 is a side elevational view showing a paper supply device used in another embodiment of the invention.
Figure 10:
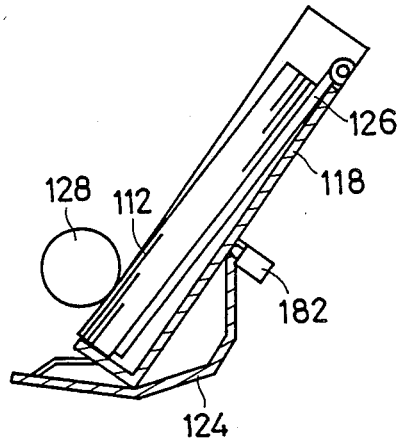
FIG. 10 is a side elevational view showing a paper supply device used in a further embodiment of the invention.

It is noted that the thickness of the recording medium may be changed in the situations other than those indicated above. For instance, the cut sheets 110, 112 on the selected sheet stacker 126, 134 may be replaced by another type of cut sheets whose thickness is different from that of the sheet 110, even where the cut sheet 110, 112 are not depleted. In this case, the operation mode is unchanged, but the sheet stacker 126, 134 is pivoted to its fully retracted position toward the bottom of the stacker casing 118, 120 when the newly used cut sheets are set on the stacker. The sheet stacker 126, 134 is automatically moved to its fully retracted position by a motor, or alternatively manually moved to that position by the operator. In the former case, the replacement of the cut sheets (i.e., the situation which involves a change in the thickness of the recording medium) can be detected by a signal which activates the motor. In the latter case, the replacement may be detected by a signal generated by a suitable switch as indicated at 180 in FIG. 9 by way of example, which is adapted to detect the fully retracted position of the sheet stacker 126.

Where the stacker casings 118, 120 are removed from the printing apparatus when they are loaded with the cut sheets, the replacement of the cut sheets may be detected by a signal generated by a suitable switch as indicated at 182 in FIG. 10 by way of example, which is adapted to detect the removal of the appropriate stacker casing 118, 120.

The signal generated by the PRINT START switch 158 may also be utilized to detect the situations which involve a possibility of a change in the thickness of the recording medium.

In the illustrated embodiment, the gap between the print head 28 and the recording medium is held constant irrespective of the thickness of the recording medium. However, the gap between the print head 28 and the recording medium may be changed with teh thickness of the recording medium.

Figure 8:
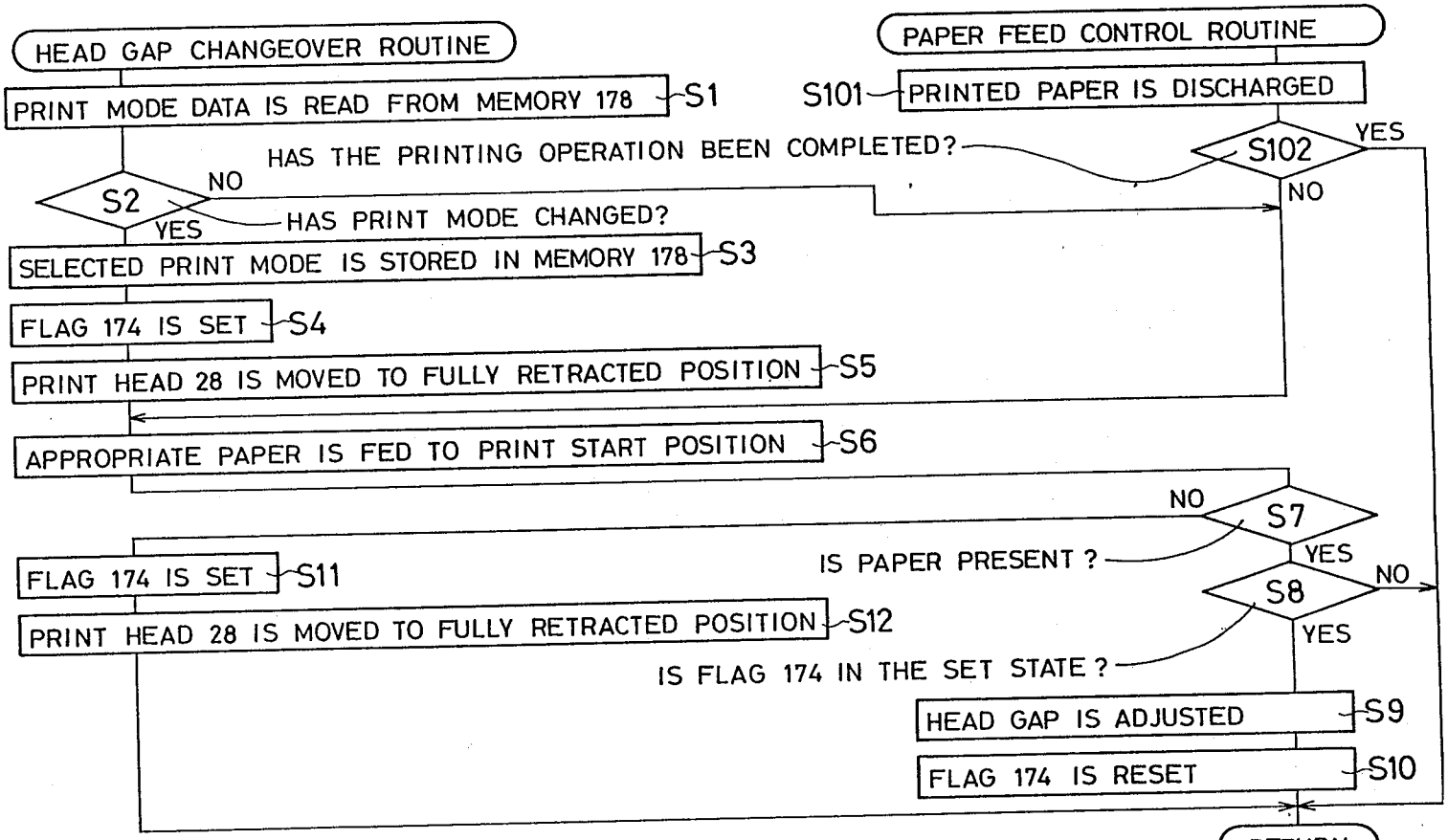
FIG. 8 is a flow chart illustrating a part of control programs stored in a ROM of a computer which constitutes a major portion of the control device, the part being associated with the concept of the present invention.
Figure 11:
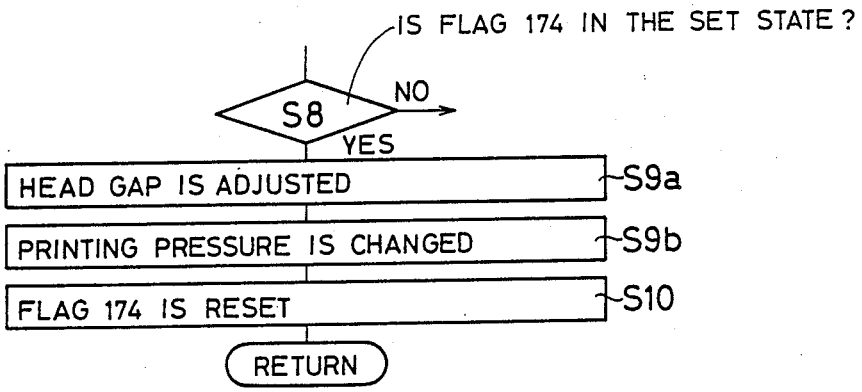
FIGS. 11 and 12 are views showing a further embodiment of the invention.
Figure 12:
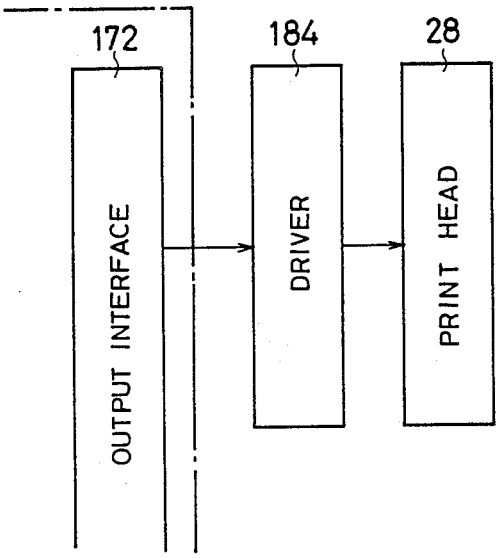

While the embodiment illustrated in the flow chart of FIG. 8 is adapted to adjust only the head gap between the print head 28 and the platen 18, it is possible that not only the head gap but also the printing pressure of the print wires 43 are adjusted. In this case, the head gap is adjusted in step S9a, and then the printing pressure of the print wires 43 is adjusted in the following step S9b, as indicated in FIG. 11, by way of example. The printing pressure may be changed by controlling the level of the signals applied to a driver as indicated at 184 in FIG. 12, for regulating the amount of electric current applied to the solenold coils of the print wires 43.

The means for detecting the thickness of the recording medium may be constituted by any other suitable device, such as a reflection type photoelectric sensor as disclosed in laid-open Publication No. 60-141249 of unexamined Japanese Patent Application.

While the print head 28 used in the illustrated embodiments is a dot-matrix type using the print wires 43, the principle of the present invention is equally applicable to other types of printing apparatus such as an ink jet printer.

It will be understood that the present invention may be embodied with various other changes, modifications and improvements, which may occur to those skilled in the art, without departing from the spirit and scope of the invention defined in the following claims.

What is clamed is:

1. A printing apparatus for printing on a recording medium, comprising:

a platen mounted on a frame, for supporting the recording medium;

a print head for effecting a printing operation on the recording medium supported by the platen, while the print head is moved along the platen;

changeover means for changing a printing condition of the print head;

a plurality of medium delivery devices for delivering different types of the recording medium, at least one of said medium delivery devices including at least one of a sheet stacker for supporting a stack of cut sheets as one of said different types of recording medium and pressing a top sheet of said stack against a feed roll, and a paper casing supported by said frame for accommodating a corresponding one of said different types of recording medium;

a medium feeding device for feeding the recording medium from one of said medium delivery devices a along a feed path leading to a printing position between said platen and said print head;

at least one of five elements which consist of (a) a first detector generating a first signal when said sheet stacker is moved to a fully retracted position thereof remote from said feed roll, (b) a second detector generating a second signal when said paper casing is removed from said frame, (c) selector means for generating a third signal for selecting one of said medium delivery devices from which the recording medium is delivered for printing by said print head, (d) a third detector generating a fourth signal indicative of an absence of the recording medium from said selected medium delivery device, in said feed path, and thereby detecting depletion of said recording medium in said selected medium delivery device, and (e) an operator-controlled print start switch for generating a fifth signal for initiating said printing operation;

medium thickness detecting means for detecting the thickness of the recording medium; and control means responsive to a trigger signal which consists of one of said first, second, third, fourth and fifth signals and which is indicative of a possibility of a change in the thickness of the recording medium, for activating said medium thickness detecting means to detect the thickness of the recording medium, and activating said changeover means to change the printing condition of said print head, depending upon the thickness of the recording medium detected by said medium thickness detecting means.

2. A printing apparatus according to claim 1, wherein said printing condition of said print head comprises a head gap between said print head and said platen.

3. A printing apparatus according to claim 1, wherein said print head consists of a dot matrix print head having at least one print wire, and said printing condition of said print head comprises a printing pressure of the print wires which acts on the recording medium.

4. A printing apparatus according to claim 1, wherein said medium selector means comprises an operator-controlled selector switch for selecting one of said medium delivery devices.

5. A printing apparatus according to claim 4, wherein said control means comprises a counter whose content is changed each time said selector switch is operated, said medium thickness detecting means and said changeover means are activated depending upon the content of said counter.

6. A printing apparatus for printing on a recording medium, comprising:

a platen mounted on a frame, for supporting the recording medium;

a print head for effecting a printing operation on the recording medium supported by the platen, while the print head is moved along the platen;

a plurality of medium delivery devices for delivery-ing different types of the recording medium;

medium selector means for selecting one of said medium delivery devices from which the recording medium is delivered for printing by said print head, and for generating a trigger signal indicative of an operation of said medium selector means by an operator;

changeover means for changing a head gap between said print head and said platen;

control means responsive to said trigger signal from said signal generating means, for activating said changeover means to change said head gap.

7. A printing apparatus according to claim 6, said control means is operated to activate said changeover means, at least at the end of an delivery of said recording medium immediately following the generation of said trigger signal.

8. A printing apparatus for printing on a recording medium, comprising:

a platen mounted on a frame, for supporting the recording medium;

a print head for effecting a printing operation on the recording medium supported by the platen, while the print head is moved along the platen;

gap adjusting means for adjusting a gap between the print head and a surface of the recording medium, by first advancing said print head into contact with the surface of the medium and then retracting the print head by a predetermined distance;

automatic medium delivering means for automatically feeding sheets one after another as one type of recording medium, toward a printing position between said print head and said platen, said sheets having a same thickness;

another medium delivery means for delivering at least one type of recording medium different from said one type, toward said printing position;

selector means for generating a first signal for selecting said automatic delivering means and generating a second signal for said anther medium delivering means; and control means responsive to said first signal, for activating said gap adusting means for only a first one of said sheets delivered from said automatic medium delivering means, and responsive to said second signal, for activating said gap adjusting means for each of said at least one type of recording medium delivered from said another medium delivering means each time said control means receives said second signal.

9. A printing apparatus according to claim 8, wherein said automatic medium delivering means comprises at least one feed roll, at least one sheet stacker each supporting a stack of cut sheets as said one type of recording medium and pressing a top sheet of said stack against said at least one feed roll, and means for generating a third signal when said sheet stacker is moved to a fully retracted position thereof remote from said at least one feed roll, said control means being also responsive to said third signal, for activating said gap adjusting means for only a first one of said cut sheets of said stack which are delivered from said sheet stacker after said control means receives said third signal.

10. A printing apparatus according to claim 8, wherein said another medium delivering means comprises a device for permitting an operator to manually insert said at least one type of recording medium different from said one type, toward said printing position.

11. A printing apparatus according to claim 8, wherein said another medium delivering means comprises a device for feeding a web as said at least one type of recording medium different from said one type, toward said printing position.

12. A printing apparatus according to claim 8, wherein said selector means comprises an operator-controlled selector switch for selecting one of said automatic medium delivering means and said another medium delivering means.

13. A printing apparatus according to claim 12, wherein said control means comprises a counter whose content is changed each time said selector switch is operated, said changeover means being activated depending upon the content of said counter.

14. A printing apparatus according to claim 9, further comprising detector means for generating a fourth signal indicative of an absence of said stack of cut sheets on said sheet stacker, said control means activating said gap adjusting means after said fourth signal is generated while said first signal is present, for activating said gap adjusting means for only the first one of said cut sheets of said stack which are delivered from said sheet stacker after said control means receives said fourth signal.

15. A printing apparatus according to claim 8, further comprising detector means for generating a third signal indicative of an absence of said at least one type of recording medium different from said one type in a feed path from said another medium delivering means toward said printing position, said control means being also responsive to said third signal while said second signal is present, for activating said changeover means for each of said at least one type of recording medium which is delivered from said another medium delivering means after said control means receives said third signal.

16. A printing apparatus for printing on a recording medium, comprising:

a platen mounted on a frame, for supporting the recording medium;

a print head for effecting a printing operation on the recording medium supported by the platen, while the print head is moved along the platen;

gap adjusting means for adjusting a gap between the print head and a surface of the recording medium, by first advancing said print head into contact with the surface of the medium and then retracting the print head by a predetermined distance;

automatic medium delivering means for automatically feeding sheets one after another as one type of recording medium, toward a printing position between said print head and said platen, said sheets having a same thickness;

a manual medium insertion device for permitting an operator to manually insert another type of recording medium different from said one type, toward said printing position;

a web feeding device for feeding a web toward said printing position;

selector means for generating a first signal for selecting said automatic delivering means. generating a second signal for selecting said manual medium insertion device, and generating a third signal for selecting said web feeding device;

detector means for generating a fourth signal indicative of an absence of said another type of recording medium and said web in a feed path leading to said printing position; and control means responsive to said first signal, for activating said gap adjusting means for only a first one of said sheets delivered from said automatic medium delivering means, said control means activating said gap adjusting means for one of said another type of recording medium and said web corresponding to one of said second and third signals, and which is manually inserted or fed by a corresponding one of said manual medium insertion device and said web feeding device, after said control means receives said fourth signal while said one of said second and third signals is present.

17. A printing apparatus according to claim 16, wherein said automatic medium delivering means comprises at least one feed roll, at least one sheet stacker each supporting a stack of cut sheets as said one type of recording medium and pressing a top sheet as said stack against said at least one feed roll, and means for generating a fifth signal when said sheet stacker is moved to a fully retracted position thereof remote from said at least one feed roll, said control means being also responsive to said fifth signal, for activating said gap adjusting means for only the first one of said cut sheets of said stack which are delivered from said sheet stacker after said control means receives said fifth signal.

18. A printing apparatus according to claim 17, wherein said selector means comprises an operator-controlled selector switch for selecting one of said automatic medium delivering means, said manual medium insertion device and said web feeding device.

* * * * *